US009784261B2

(12) United States Patent
Hagita et al.

(10) Patent No.: US 9,784,261 B2
(45) Date of Patent: Oct. 10, 2017

(54) GASKET AND MOTOR-DRIVEN COMPRESSOR

(75) Inventors: Takayuki Hagita, Tokyo (JP); Shinichi Takahashi, Tokyo (JP); Takeshi Hirano, Tokyo (JP); Noriaki Arashi, Tokyo (JP); Takayuki Watanabe, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 978 days.

(21) Appl. No.: 13/696,158

(22) PCT Filed: Aug. 30, 2011

(86) PCT No.: PCT/JP2011/069558

§ 371 (c)(1),
(2), (4) Date: Nov. 5, 2012

(87) PCT Pub. No.: WO2012/032967

PCT Pub. Date: Mar. 15, 2012

(65) Prior Publication Data

US 2013/0048102 A1 Feb. 28, 2013

(30) Foreign Application Priority Data

Sep. 10, 2010 (JP) ..... 2010-202664

(51) Int. Cl.
*F04B 39/14* (2006.01)
*F04B 39/12* (2006.01)
*F04B 39/00* (2006.01)

(52) U.S. Cl.
CPC ..... *F04B 39/121* (2013.01); *F04B 39/0027* (2013.01); *F04B 39/14* (2013.01); *Y10T 137/6851* (2015.04)

(58) Field of Classification Search
CPC .... F04B 39/121; F04B 39/0027; F04B 39/14; F04B 27/0891; F04B 53/16–53/168;
(Continued)

(56) References Cited

U.S. PATENT DOCUMENTS 3,356,293 A * 12/1967 Butts ..... F04B 39/121 417/312
5,704,771 A * 1/1998 Fujisawa et al. ..... 417/417
(Continued)

FOREIGN PATENT DOCUMENTS

JP 05-086070 U 11/1993
JP 06-014625 U 2/1994
(Continued)

OTHER PUBLICATIONS

Machine Translation of Japanese Patent JP 2004301071 A to Hasegawa et al/Kurita et al.*
(Continued)

*Primary Examiner* — Peter J Bertheaud
*Assistant Examiner* — Dnyanesh Kasture
(74) *Attorney, Agent, or Firm* — Westerman, Hattori, Daniels & Adrian, LLP

(57) ABSTRACT

Provided is a gasket (30), which is used in a motor-driven compressor including an inverter housing, including a flat core of metal (31) and an elastic foamed material (32) so disposed as to cover both surfaces of the core (31), and the gasket (30) has embossed recesses and projections (33) with predetermined shapes. It is possible to enhance sealing performance to seal the inverter housing by using this gasket (30). A motor-driven compressor using this gasket (30) enhances vibration prevention.

5 Claims, 5 Drawing Sheets

(58) Field of Classification Search
CPC .... F04B 39/12–39/128; F04B 27/1081; F04D 29/08; F04D 28/083; F04C 2240/808; F16J 15/0818–15/0893
See application file for complete search history.

(56) References Cited

U.S. PATENT DOCUMENTS

| | | | | |
|---|---|---|---|---|
| 5,852,957 | A * | 12/1998 | Saito | 74/606 R |
| 5,975,539 | A | 11/1999 | Ueda et al. | |
| 6,564,576 | B2 * | 5/2003 | Shibuya | 62/505 |
| 6,682,080 | B2 * | 1/2004 | Miyaoh | F16J 15/0818 277/592 |
| 8,303,271 | B2 * | 11/2012 | Ikeda et al. | 417/371 |
| 2003/0035739 | A1 * | 2/2003 | Seo | F04B 39/0061 417/312 |
| 2005/0218607 | A1 * | 10/2005 | Fujino | F16J 15/0825 277/651 |
| 2006/0171127 | A1 * | 8/2006 | Kadoya et al. | 361/752 |
| 2008/0157696 | A1 * | 7/2008 | Pokharna | H05B 41/042 315/276 |
| 2008/0181791 | A1 * | 7/2008 | Iguchi et al. | 417/45 |
| 2009/0010786 | A1 * | 1/2009 | Koide et al. | 417/423.14 |
| 2010/0172770 | A1 * | 7/2010 | Ichise et al. | 417/366 |
| 2011/0091337 | A1 | 4/2011 | Suzuki et al. | |

FOREIGN PATENT DOCUMENTS

| | | | | |
|---|---|---|---|---|
| JP | 09-303564 | A | 11/1997 | |
| JP | 2000-048835 | A | 2/2000 | |
| JP | 2004301071 | A * | 10/2004 | F04B 39/00 |
| JP | 3802477 | B2 | 7/2006 | |
| JP | 2007-224902 | A | 9/2007 | |
| JP | 2009-264172 | A | 11/2009 | |
| JP | 2010-059941 | A | 3/2010 | |
| JP | 2010-163957 | A | 7/2010 | |

OTHER PUBLICATIONS

Decision to Grant a Patent dated Oct. 21, 2014, for Japanese Application No. 2010-202664. "The Decision to Grant has been received." (3 pages).
International Search Report of PCT/JP2011/069558, mailing date Nov. 22, 2011.
Written Opinion of PCT/JP2011/069558, mailing date Nov. 22, 2011.

* cited by examiner

GASKET AND MOTOR-DRIVEN COMPRESSOR

TECHNICAL FIELD

The present invention relates to a gasket and a motor-driven compressor, particularly to a motor-driven compressor for a car air conditioner and a gasket applied to the same.

BACKGROUND ART

A motor-driven compressor in which an inverter is integrally incorporated is used as a compressor for an air conditioner installed in a vehicle such as an electric vehicle or a hybrid vehicle.

Such an inverter-integrated motor-driven compressor includes an inverter housing (inverter box) disposed on the outer periphery of a housing where an electric motor and a compression mechanism are embedded. Inside the inverter housing, an inverter is incorporated so as to convert direct-current power supplied from a high voltage source unit into three-phase alternating current power, and supply this power to the electric motor through a glass-sealed terminal.

The inverter housing includes a housing body having an aperture through which the inverter is inserted and a cover member for sealably covering the aperture. The housing body and the cover member are made of metal.

The inverter requires damp-proofing and water-proofing, so that the inverter is made in a water-proofing structure, by enwrapping part of electrical equipment with resin or filling gel material in the inverter housing, and sealing the aperture of the housing body with the cover member.

This sealing is accomplished by disposing an O ring, a gasket or a resin seal member between the periphery of the aperture and the cover member. PTL 1 discloses a horizontal-inverter-type motor-driven compressor for a vehicle in which a resin frame is disposed and adhesively-bonded between a housing body and a cover member of an inverter.

A distribution cable connected to the inverter is pulled out through a wall of the housing body via a grommet, for example. Sealing is also needed on the periphery of this grommet.

CITATION LIST

Patent Literature

{PTL 1}
The Publication of Japanese Patent No. 3802477

SUMMARY OF INVENTION

Technical Problem

FIG. 9 is a diagram of illustrating a concept of a sealed portion sealed with an O ring 50. The O ring 50 is simply fit in a groove 51 formed in the vicinity of the aperture of a housing body 7, and thus the housing body 7 and a cover member 8, that is, metal members come in contact with each other when the sealed portion is sealed. A motor-driven compressor for a car air conditioner is preferably light-weight, and a cover member of an inverter housing is manufactured to have a thinner thickness. Hence, if metal members are in contact with each other, vibrations of the compressor generated during the operation of the compressor propagate to the cover member, which causes noises. As illustrated in FIG. 10, even in a method of restricting deformation of a gasket 52 by a step portion, there is a large area in metal members in contact with each other, so that vibrations of a compressor similarly propagate to a cover member.

FIG. 11 is a diagram of illustrating a concept of a sealed portion using a liquid gasket 53. In this liquid gasket 53 having a thinner thickness, vibrations of a compressor easily propagate to a cover member.

To address the above mentioned difficulties, it is efficient to make a cover member thicker and heavier, but a too thick and too heavy cover member hinders the function as a motor-driven compressor for a car air conditioner.

As illustrated in PTL 1, in the case of using a seal member of resin material, a seal member having a thicker thickness deteriorates sealing performance relative to electromagnetic waves.

As mentioned above, it is difficult, in the prior art, to achieve vibration prevention and sealing performance in a gasket applied to a motor-driven compressor for a car air conditioner.

The present invention has been made in the light of the above facts, and has an object to provide a gasket with vibration prevention and sealing performance and a motor-driven compressor using the same.

Solution to Problem

In order to solve the above problems, the present invention employs the following solutions.

The gasket according to the first aspect of the present invention is a gasket used in a motor-driven compressor including an inverter housing, in which the gasket includes a flat core of metal; and an elastic foamed material disposed so as to cover both surfaces of the core, and the gasket has embossed recesses and projections with predetermined shapes.

According to the gasket of the first aspect of the present invention, a desired damping effect can be attained by using the elastic foamed material; thus it is possible to realize a gasket capable of attaining high vibration prevention performance even with low contact pressure. The flat core of metal is disposed between the elastic foamed materials, thereby attaining stability of the shape; thus it is possible to enhance operability at the time of incorporating the gasket in the inverter housing. The embossed recesses and projections with the predetermined shapes provide an effect to enhance the contact pressure, thereby realizing the gasket having high sealing performance.

The motor-driven compressor according to the second aspect of the present invention includes a housing body having an aperture, where an inverter is housed; a cover member covering the aperture; and a gasket so disposed between the housing body and the cover member as to seal a gap between the housing body and the cover member. The gasket includes a flat core of metal; and an elastic foamed material disposed so as to cover both surfaces of the core, and the gasket has embossed recesses and projections with predetermined shapes.

According to the motor-driven compressor of the second aspect of the present invention, a desired damping effect can be attained by using the gasket including the elastic foamed material. Accordingly, it is possible to prevent vibrations of the compressor from propagating, thereby realizing the noise reduction type motor-driven compressor. The flat core of metal is disposed between the elastic foamed materials, so that the shape becomes stable, thereby enhancing operability in assembling the inverter housing. The recesses and projections with predetermined shapes applied to the gasket by embossing provide an effect to enhance the contact pressure. As a result, it is possible to realize the motor-driven compressor including the inverter housing with high sealing performance.

In the motor-driven compressor of the second aspect of the present invention, the housing body and the cover member may be clamped to each other with bolts, and the recesses and projections on the gasket may be located more inward than the bolts in the housing body.

In this configuration, the recesses and projections of the gasket are disposed more inward than the bolts, so as to generate more contact pressure between the gasket and each member than in the case of disposing the recesses and projections more outward than the bolts, thereby realizing higher sealing performance.

In the motor-driven compressor of the second aspect of the present invention, the motor-driven compressor further may includes a cut-out so formed in the housing body as to reach the aperture; a cable holder of non-metal fit in the cut-out; and a liquid gasket so disposed between the cable holder and the cover member as to seal a gap between the cable holder and the cover member.

In this configuration, the cut-out configured to reach the aperture facilitates the cable connection at the time of assembling the inverter housing. The cable holder of non-metal prevents vibrations of the motor-driven compressor from propagating to the cover member. In the case of using the gasket including elastic foamed material, it is hard to generate contact pressure between the cable holder and the gasket. According to one of the above described aspects, it is possible to enhance the sealing performance between the cable holder and the cover member by inserting a liquid gasket therebetween.

Advantageous Effects of Invention

According to the present invention, it is possible to provide a gasket with high vibration prevention and sealing performance by covering both surfaces of a metal core with elastic foamed materials and by embossing on this. Such a gasket attains high sealing performance even with low contact pressure, thereby reducing the number of bolts used for clamping the housing body and the cover member to each other. Such a gasket used in the cover member of the inverter housing realizes a noise-reduction type motor-driven compressor.

DESCRIPTION OF EMBODIMENT

Hereinafter, description will be provided on one embodiment of the motor-driven compressor according to the present invention with reference to the drawings.

Figure 1:
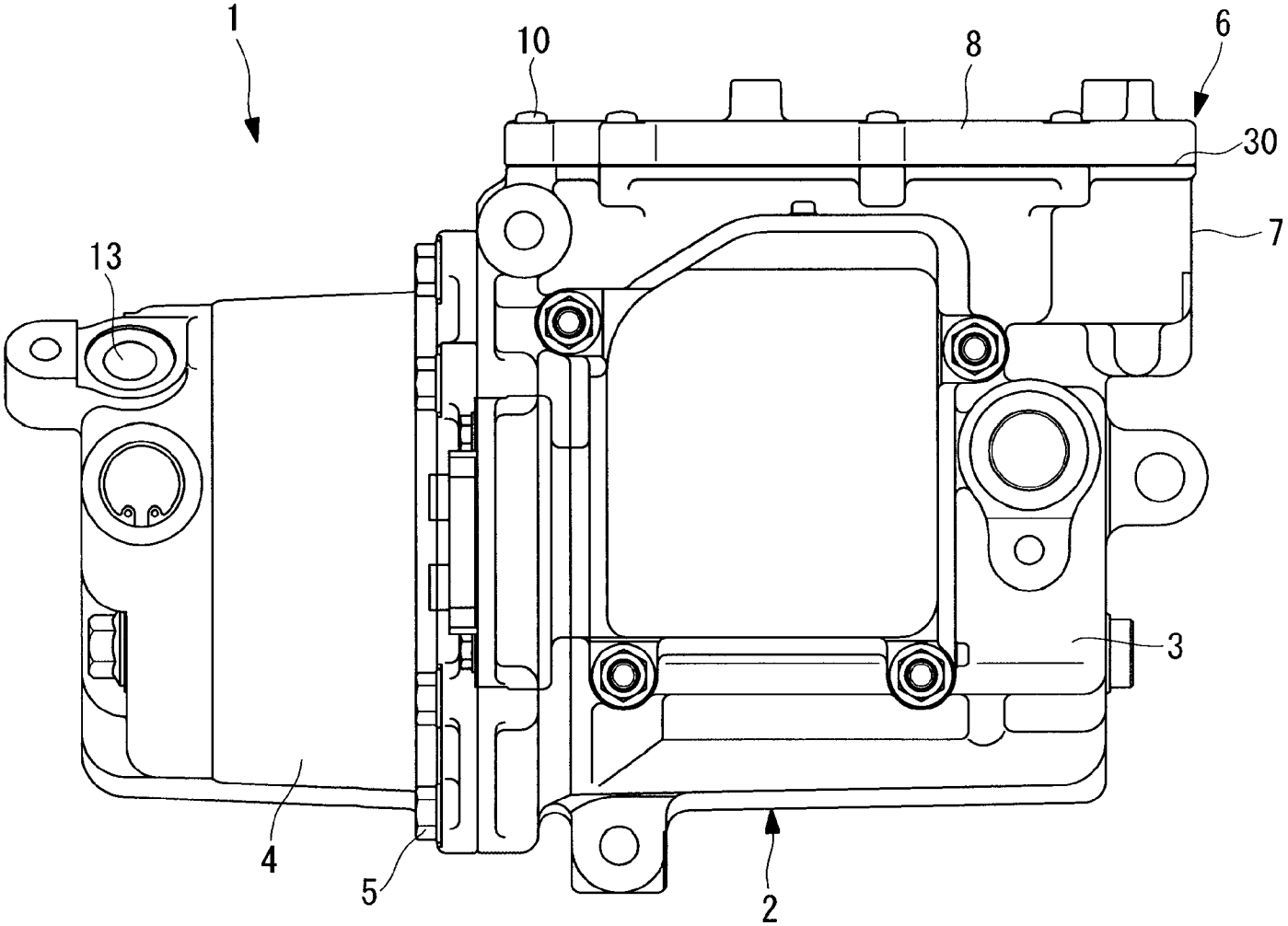
FIG. 1 is an appearance side view of an inverter-integrated compressor used in an air conditioner for a vehicle.

FIG. 1 illustrates an appearance side view of an inverter-integrated compressor used in a car air conditioner as one example.

The inverter-integrated motor-driven compressor 1 includes a housing 2 having a pressure-resistant structure that forms an outer shell of the motor-driven compressor 1. The housing 2 having this pressure-resistant structure is configured by clampingly fixing a motor housing 3 housing a not-illustrated electric motor thereinside to a compressor housing 4 housing a not-illustrated compression mechanism thereinside with bolts 5 so that they are integrated with each other.

An inverter housing 6 is so disposed on the upper portion of the outer periphery of the motor housing 3 as to be integrated with the motor housing 3.

Inside the inverter housing 6, an inverter is incorporated to convert direct-current power supplied from a high voltage source unit into three-phase alternating-current power and supply this power to the electric motor, thereby variably controlling the revolving speed of the motor-driven compressor in accordance with the load of the air conditioner.

The inverter is configured to be connected to an external high voltage source unit or to an ECU (electric control unit) installed in the vehicle, which is a high order controller of the vehicle via a distribution cable.

Figure 2:
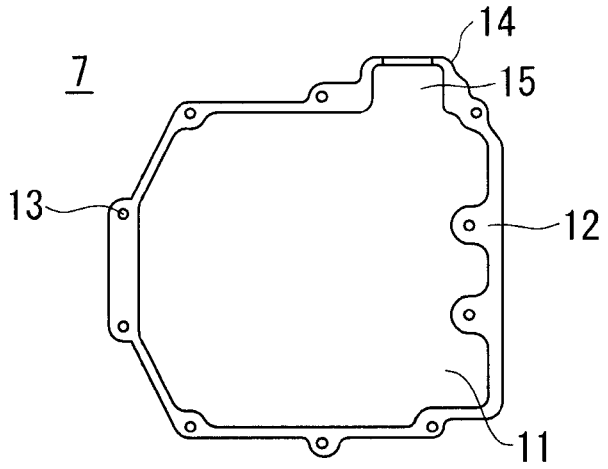
FIG. 2 is a plan view of a housing body.
Figure 3:
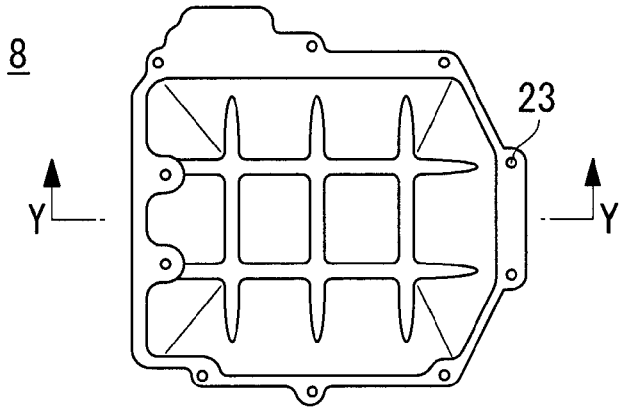
FIG. 3 is a plan view of a cover member.
Figure 4:
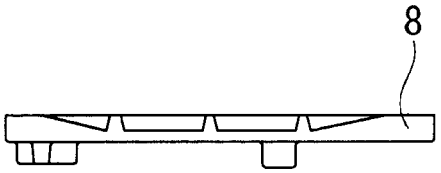
FIG. 4 is a cross sectional view taken along line Y-Y of FIG. 3.

FIG. 2 is a plan view of illustrating a housing body. FIG. 3 is a plan view of illustrating a cover member. FIG. 4 is a cross sectional view taken along line Y-Y of FIG. 3.

The inverter housing 6 includes a housing body 7, a cover (cover member) 8 sealably covering the housing body 7, and a gasket disposed between the housing body 7 and the cover member 8. The housing body 7 and the cover member 8 are clamped to each other with bolts.

The housing body 7 is made of material such as die-cast aluminum, and has a box structure surrounded by a surrounding wall 12 with a predetermined height that forms an aperture 11 opening its one surface (upper surface of FIG. 1). The top of the surrounding wall 12 has a plan surface, where bolt holes 13 are formed with predetermined intervals. The bolt holes 13 may be formed at an approximately 50 mm interval therebetween, for example. The inside of the plan surface on the top of the surrounding wall 12 may be formed to be a surface inclined inwardly downward of the housing body 7.

The cover member 8 is made of a rolled steel product to which corrosion protection is applied by plating or material such as die-cast aluminum, and has a shape suitable for sealing the aperture 11 of the housing body 7. The cover member 8 may have a thickness of approximately 1 mm, for example. The periphery of a surface of the cover member 8 that comes in contact with the housing body 7 has a plan surface having the substantially same shape as that of the plan surface on the top of the surrounding wall 12 of the housing body 7. This plan surface is provided with bolt holes 23 at positions corresponding to the bolt holes 13 formed in the housing body 7.

The gasket includes a core and an elastic foamed material covering the both surfaces of the core. The core has desired rigidity, and is made of a flat plate in a flat shape made of a deformable material. For example, an iron plate having a thickness of approximately 0.15 mm to 0.25 mm may be used as the core.

As the elastic foamed material, foamed rubber with a predetermined thickness containing NBR or others with desired elasticity may be used. For example, the thickness of the elastic foamed material before clamped may be approximately from 0.15 mm to 0.3 mm.

Figure 5:
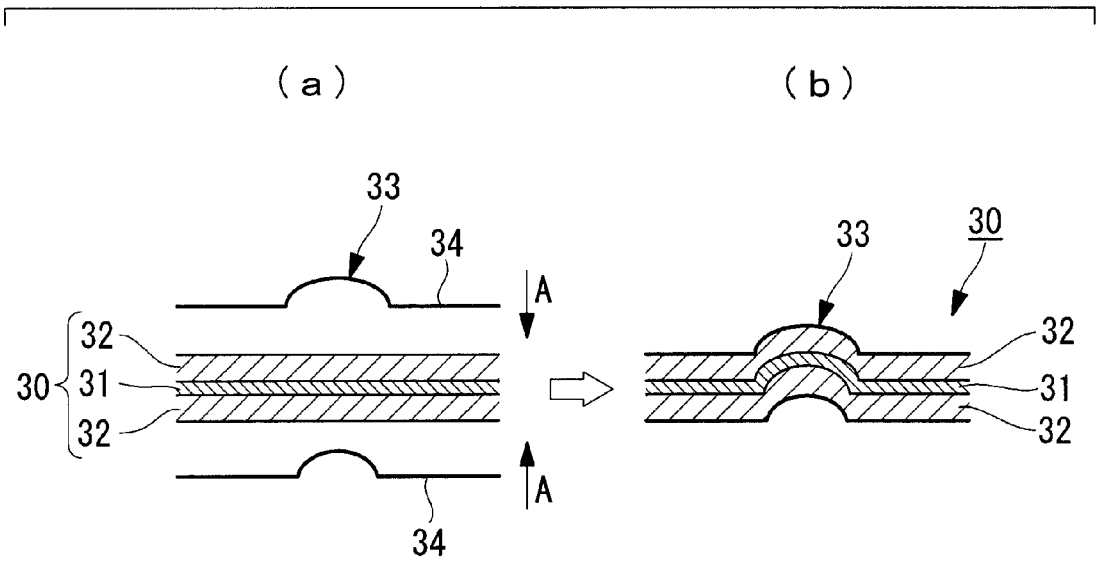
FIG. 5 is an explanatory view of embossing on a gasket according to the present embodiment.

The gasket is applied with recesses and projections formed in the predetermined shapes by embossing. FIG. 5 is an explanatory view of embossing on the gasket according to the embodiment. FIG. 5(*a*) illustrates the gasket before embossing is applied and FIG. 5(*b*) illustrates the gasket after embossing is applied, respectively. In FIG. 5, embossing is applied on the gasket 30 in such a manner that the gasket 30 is held on its upper and lower surfaces between dies 34 having recesses and projections 33 in the predetermined shapes, and is pressed in the arrow A direction. The recesses and projections 33 may be set at approximately 0.3 mm so as not to deform the entire gasket.

Figure 6:
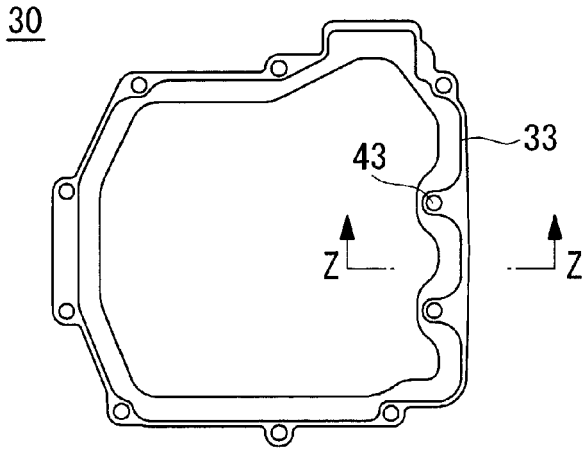
FIG. 6 is a plan view of illustrating a gasket applicable to the inverter-integrated compressor of FIG. 1.

The gasket 30 is provided with bolt holes 43 allowing the housing body 7 and the cover member 8 to be clamped to each other. As one example, FIG. 6 illustrates a plan view of the gasket 30, applicable to the inverter-integrated compressor of FIG. 1, on which the recesses and projections 33 in the predetermined shapes are formed. The gasket 30 after embossing is applied as illustrated in FIG. 5(*b*) corresponds to the cross section taken along line Z-Z of FIG. 6.

The cover member 8 is disposed at the top of the surrounding wall 12 so as to cover the aperture 11 of the housing body 7. The housing body 7 and the cover member 8 are clamped with the bolts 10 with the gasket 30 disposed therebetween.

Figure 7:
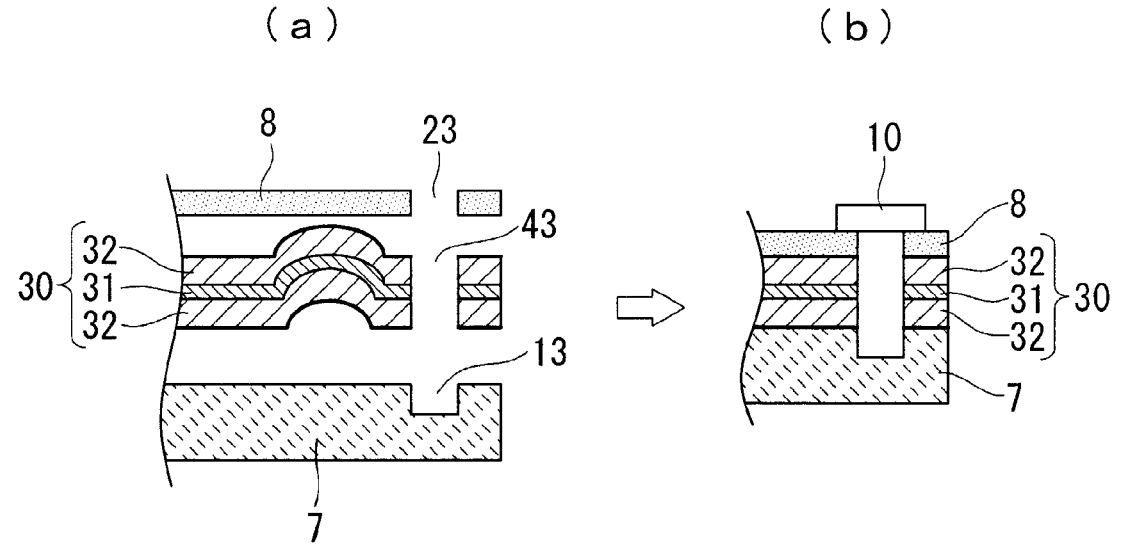
FIG. 7 is a drawing of illustrating one example of bolt clamping.

FIG. 7 illustrates one example of the bolt clamping. FIG. 7(*a*) illustrates a state before clamped with the bolts and FIG. 7(*b*) illustrates a state after clamped with the bolts. The recesses and projections 33 applied on the gasket 30 may be disposed on the plan surface on the top of the surrounding wall 12 that is located more inward than the bolt holes (13, 23) formed on the housing body 7 and the cover member 8. In this state, the cover member 8 is fixed with screws 10 or the like, thereby sealing the aperture 11 into a water-proofing state.

The portion of the cover member 8 located more outward than the bolt holes (13, 23) is likely to be deformed at the time of the bolt clamping, and if the gasket is located more outward than these bolt holes, the waterproofing effect is hard to be attained due to insufficient contact pressure of the gasket.

The cover member 8 is made of a rolled steel product to which corrosion protection is applied by plating or material such as die-cast aluminum, and has rigidity sufficient for compressing the gasket 30, so that the cover member 8 is not deformed by reaction force from the gasket 30, which attains sufficient waterproofing performance.

The auditory sense of human varies in sensitivity depending on the frequency band, so that sounds having the same sound pressure level may be heard differently depending on their frequency bands. Accordingly, the thickness of the cover member, the kind and the thickness of the elastic foamed material, the location of the bolt holes and the clamping force of the bolts may be set such that the eigenvalue after the housing body 7 and the cover member 8 is clamped is set at 1 kHz or less.

The surrounding wall 12 of the housing body 7 is provided with a projected portion 14 projecting outward at an upper position of one side face of the surrounding wall 12. The projected portion 14 has a cut-out formed in an approximately U shape whose opening reaches the aperture 11. A cable holder 15 is fitted in the cut-out. The cable holder 15 is made of non-metal material, which is hard rubber in an approximately rectangular parallelepiped shape, for example. A through hole 16 through which a distribution cable is inserted is formed in the cable holder 15 in its depth direction. A number of through holes may be formed so that a predetermined number of distribution cables can be inserted therethrough. If the cable holder 15 is formed in the cut-out, a liquid gasket is applied between the cable holder 15 and the cover member 8.

Instead of forming the projected portion 14 and the cut-out, a through hole may be formed in one side face of the surrounding wall 12, and the cable holder 15 may be disposed in this through hole.

Figure 8:
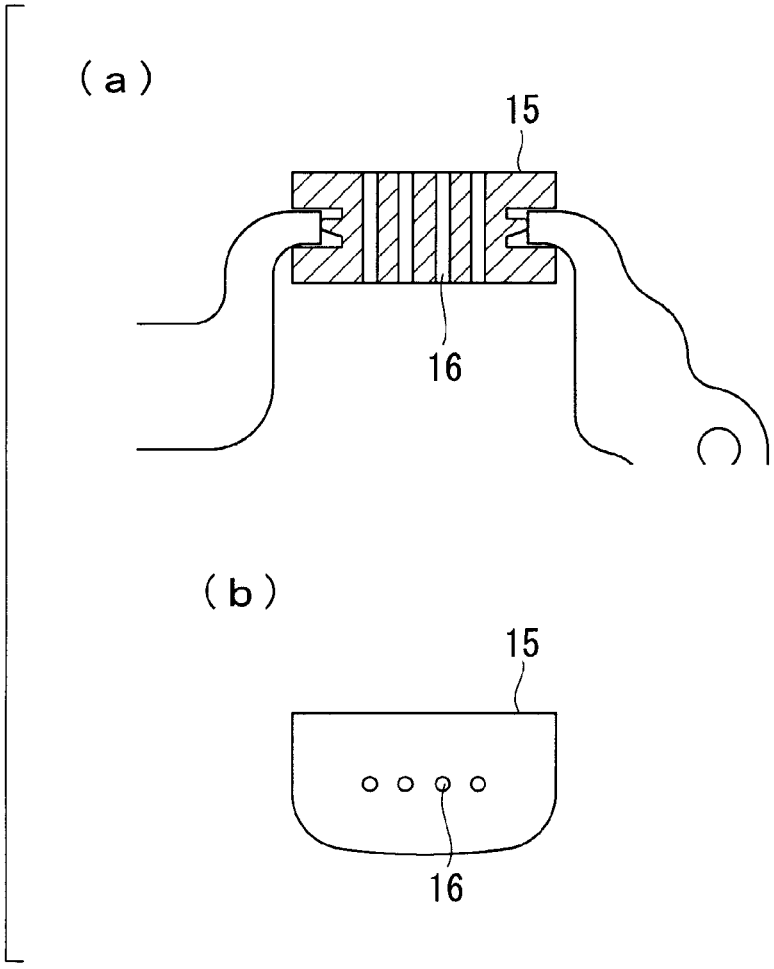
FIG. 8 is a drawing of illustrating one example of a cable holder.
Figure 9:
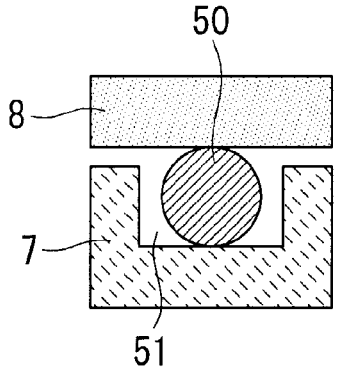
FIG. 9 is a diagram of illustrating a concept of a sealed portion sealed with an O ring.
Figure 10:
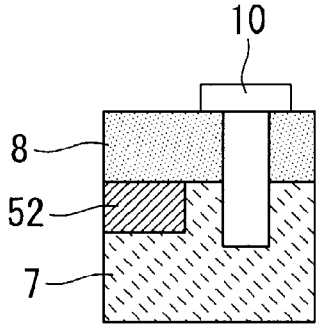
FIG. 10 is a diagram of illustrating a concept of a sealed portion where a gasket is restricted by a step portion.
Figure 11:
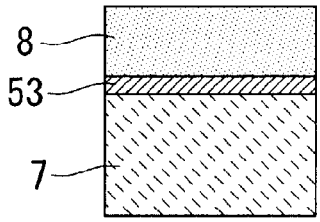
FIG. 11 is a diagram of illustrating a concept of a sealed portion using a liquid gasket.

FIG. 8 illustrates one example of the cable holder 15. FIG. 8(*a*) is a plan view thereof and FIG. (b) is a side view thereof.

Description will now be provided on the operation and effect of the motor-driven compressor having the above described configuration.

The elastic foamed material 32 has desired elasticity to readily provide damping effect. A too thick thickness of the elastic foamed material 32 lowers the axial tension, which lowers the bolt clamping force at the time of clamping the housing body 7 to the cover member 8 with the bolts 10. A too thick thickness of the elastic foamed material 32 is also likely to deteriorate its quality due to the clamping pressure of the bolts. On the other hand, a too thin thickness of the elastic foamed material 32 deteriorates vibration prevention. For this reason, the elastic foamed material is provided with a predetermined thickness. Hence, it is possible to provide a gasket with sealing performance, vibration prevention and product reliability.

The elastic foamed material 32 is so soft that its shape becomes unstable, which is not suitable in a standalone usage. According to the present embodiment, the gasket 30 includes the core 31, which achieves an effect to stabilize the shape of the elastic foamed material 32.

In the gasket 30 on which embossing is applied, the elastic foamed material 32 provides an effect to prevent the surface or its vicinity, in which the recesses and projections are formed, from being kinked at the time of embossing. The recesses and projections formed through embossing easily generate contact pressure; thereby attaining desired waterproofing performance even with lower contact pressure, which enables reduction of the number of the bolts 10 used for the clamping.

The cable holder 15 is made of non-metal material, and if the gasket having an elastic foamed material is disposed between the cable holder 15 and the cover member 8, sufficient contact pressure is not generated, which makes it difficult to secure sufficient sealing performance. To counter this, instead of using the gasket having an elastic foamed material, a liquid gasket may be disposed between the cable holder 15 and the cover member 8, so as to enhance sealing performance between the cable holder 15 and the cover member 8.

EXAMPLES

Waterproofing and vibration prevention were measured by using a gasket (Example 1) including the core 31 (iron plate with a thickness of 0.15 mm) with its both surfaces covered by the elastic foamed material 32 having a thickness of 0.15 mm, and also using a gasket (Example 2) provided with projections of which projection length is 0.3 mm and projection width is 1.5 mm at a position 2 mm from one end portion of the former gasket. The gasket 30 was disposed between the housing body 7 and the cover member 8 such that the projections come in contact with the cover member 8 at a position more inward than the bolt holes. The housing body 7 and the cover member 8 were so clamped to each other with bolts as to have a thickness of approximately 0.3 mm after clamped. Each interval between the adjacent bolts was set at approximately 45 mm.

It was confirmed that the inverter housing sealed by using Example 1 and Example 2 attained noise reduction of sound radiation from the inverter and also satisfied the required waterproofing function.

As similar to the above Examples, waterproofing and the vibration prevention were also confirmed on a gasket using hard rubber instead of using the elastic foamed material, but it was confirmed that this gasket had lower waterproof performance than Example 1. It should be appreciated that this results from that non-elastic foamed material is harder than elastic foamed material, which lowers its sealing performance.

REFERENCE SIGNS LIST

1 Inverter-integrated motor-driven compressor
2 Housing
3 Motor housing
4 Compressor housing
5, 10 Bolts
6 Inverter housing
7 Housing body
8 Cover member
11 Aperture
12 Surrounding wall
13, 23, 43 Bolt holes
14 Projected portion
15 Cable holder
16 Through hole
30, 52 Gaskets
31 Core
32 Elastic foamed material
33 Recesses and projections
34 Die
50 O ring
51 Groove
53 Liquid gasket

The invention claimed is:

1. A motor-driven compressor comprising:
a housing body having an aperture and housing an inverter thereinside;
a cover member covering the aperture;
a gasket so disposed between the housing body and the cover member as to seal a gap between the housing body and the cover member;
a projected portion projecting outward, which is provided at an upper position of one side face of a surrounding wall of the housing body;
a cut-out formed in the projected portion, wherein an opening of the cut-out reaches the aperture of the housing body; and
a cable holder of non-metal fit in the cut-out,
the gasket including:
a flat core of metal having two opposing surfaces; and
an elastic foamed material disposed so as to cover both surfaces of the core,
wherein the gasket has embossed recesses and projections with predetermined shapes,
wherein the core and the elastic foamed material have a same shape of the recesses and projections, and
wherein a liquid gasket is disposed between the cable holder and the cover member as to seal a gap between the cable holder and the cover member.

2. The motor-driven compressor according to claim 1, wherein
the housing body and the cover member are clamped to each other with bolts, and
the recesses and projections on the gasket are located more inward than the bolts in the housing body.

3. The motor-driven compressor according to claim 1, wherein the same shape of the
the elastic foamed material is foamed rubber containing a rubber selected from NBR and other rubbers.

4. The motor-driven compressor according to claim 1, wherein an eigenvalue of a frequency after the housing body and the cover member is clamped is set at 1 kHz or less.

5. The motor-driven compressor according to claim 1, wherein the same shape includes a curved portion.

* * * * *